United States Patent [19]

Metrailer

[11] 4,235,700

[45] Nov. 25, 1980

[54] TWO-STAGE COKING FOR THE PRODUCTION OF LOW METALS COKE

[75] Inventor: William J. Metrailer, Baton Rouge, La.

[73] Assignee: Exxon Research & Engineering Co., Florham Park, N.J.

[21] Appl. No.: 84,511

[22] Filed: Oct. 12, 1979

[51] Int. Cl.[3] ..... C10G 51/02

[52] U.S. Cl. ..... 208/54; 208/131

[58] Field of Search ..... 208/53, 54, 131

[56] References Cited

U.S. PATENT DOCUMENTS

| | | | |
|---|---|---|---|
| 2,775,549 | 12/1956 | Shea | 208/50 |
| 2,813,824 | 11/1957 | Gorin | 208/53 |
| 2,854,397 | 9/1958 | Moser | 208/78 |
| 2,879,221 | 3/1959 | Brown | 208/53 |
| 2,881,130 | 4/1959 | Pfeifer | 208/157 |
| 2,922,755 | 1/1960 | Hackley | 208/131 |
| 3,617,480 | 11/1971 | Keel | 208/131 |
| 3,671,424 | 6/1972 | Saxton | 208/127 |
| 3,769,200 | 10/1973 | Folkins | 208/53 |
| 3,959,115 | 5/1976 | Hayashi et al. | 208/53 |

*Primary Examiner*—Herbert Levine

*Attorney, Agent, or Firm*—MartheL. Gibbons

[57] ABSTRACT

A low metals coke is produced in a two-stage coking process in which the first coking stage is once-through fluid coking, and the heavy oil separated from the fluid coking zone effluent is coked in a second coking stage, which is delayed coking.

8 Claims, 1 Drawing Figure

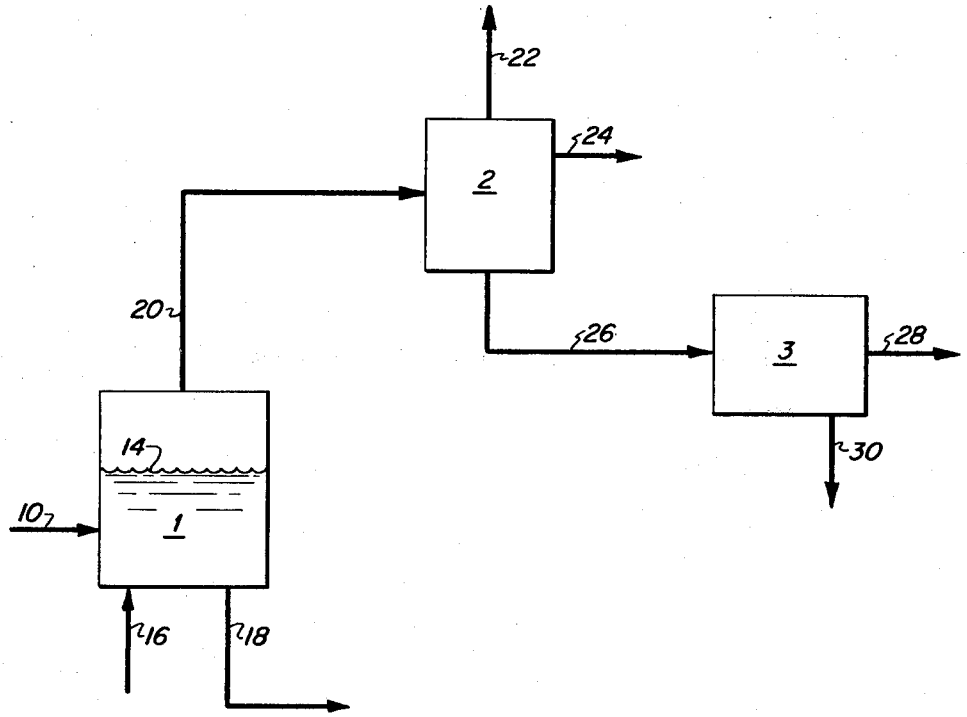
22
24
2
20
26
3
28
30
14
10
1
16
18

TWO-STAGE COKING FOR THE PRODUCTION OF LOW METALS COKE

BACKGROUND OF THE INVENTION

1. Field of the Invention

This invention relates to a process for the production of a low metals content coke by integration of fluid coking and delayed coking.

2. Description of the Prior Art

Fluid coking is a well known process which may be carried out with or without recycle of the heavier portion of the fluid coking zone effluent. As is well known in the art, the fluid coking process, shown, for example in U.S. Pat. No. 2,881,130, which is hereby incorporated by reference, uses a fluid coking vessel and an external heating vessel. A fluid bed of solids, preferably coke particles produced by the process, having a size in the range from about 40 to about 1000 microns is maintained in the coking zone by the upward passage of a fluidizing gas, usually steam, injected at a superficial velocity usually between 0.3 and 5 feet per second. The temperature in the fluid coking bed is maintained in the range of from about 850° F. to about 1200° F., preferably between 900° F. and 1100° F. by circulating solids (coke) to the heating vessel and back. The heavy oil to be converted is injected into the fluid bed and upon contact with the hot solids undergoes pyrolysis evolving lighter hydrocarbon products in vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. Product vapors, after removal of entrained solids, are withdrawn overhead from the coking zone and sent to a scrubber and a fractionator for cooling and separation.

Delayed coking is a well known process in which a hydrocarbonaceous oil heated to coking temperature is passed into a coking drum to produce a vapor phase product, including normally liquid hydrocarbons, and coke. The drum is decoked, for example, by using high pressure water jets. See *Hydrocarbon Processing,* Sept. 1978, page 103.

It is known to prepare a low ash content coke from a high ash content hydrocarbonaceous liquid feed by subjecting the liquid feed to a primary thermal treatment under mild coking conditions at temperatures ranging from 950° to 1200° F. and passing a high boiling portion of the effluent to a second thermal treatment zone under more severe conditions at 950° to 1600° F.

It is also known to form a high grade needle coke by heating petroleum residuum to about 350° to 550° C. to remove components which readily form an insoluble phase and coking the remaining residuum.

It is known to produce a high grade petroleum coke by subjecting the oil to a first delayed coking under relatively mild conditions and thereafter subjecting the uncoked heavy residual oil to a second delayed coking under relatively more severe conditions. See U.S. Pat. No. 3,959,115.

A two-stage delayed coking process is known for producing an inorganic contaminant-free coke. See U.S. Pat. No. 3,769,200.

Two-stage fluid coking processes are also known. See U.S. Pat. Nos. 2,854,397; 2,879,221 and 3,671,424.

It has now been found that fluid coking followed by delayed coking will provide advantages in the production of a low metals coke product.

SUMMARY OF THE INVENTION

In accordance with the invention there is provided, a process for producing a low metals-containing coke, which comprises the steps of:

(a) contacting a heavy hydrocarbonaceous oil feed containing metal contaminants and having a Conradson carbon content of at least 5 weight percent with hot coke particles in a fluidized bed coking zone maintained at a temperature ranging from about 850° to about 1200° F. to produce coke having a high metals content and a vapor phase effluent including a heavy hydrocarbonaceous oil having a reduced metals content relative to said oil feed;

(b) treating at least a portion of said heavy hydrocarbonaceous oil having the reduced metals content in a delayed coking zone maintained at a temperature below about 950° F. to produce coke having a low content of metal, and (c) recovering said low metals content coke.

BRIEF DESCRIPTION OF THE DRAWING

The FIGURE is a schematic process flow plan of an embodiment of the invention.

DESCRIPTION OF THE PREFERRED EMBODIMENTS

Referring to the FIGURE, a heavy hydrocarbonaceous oil having a Conradson carbon content of at least 5 weight percent and containing metal contaminants is introduced by line 10 into a fluid coking zone 1 in which is maintained a fluidized bed of solids (coke particles of 40 to 1000 microns in size) having an upper level indicated at 14. Suitable heavy hydrocarbonaceous oil feeds for the fluid coking zone include heavy and reduced petroleum crude oils; atmospheric residuum; vacuum residuum; pitch, asphalt; bitumen; other heavy hydrocarbon residues; tar sand oil; shale oil; liquid products derived from coal liquefaction processes, including coal liquefaction bottoms and mixtures thereof. Typically such feeds have a Conradson carbon content of at least 5 weight percent, preferably above 7 weight percent (as to Conradson carbon residue see ASTM D 189-65). The total metal content (vanadium, nickel, iron, etc.) of such feeds may range from about 50 to about 1200 wppm and higher. These feeds may also contain ash, for example, feeds derived from coal liquefaction processes which may contain up to about 16 weight percent ash. A fluidizing gas, such as steam, is admitted into coking zone 1 by line 16 in an amount sufficient to maintain a superficial gas velocity in the range of about 0.3 to about 5 feet per second. The fluid coking zone is operated at a temperature ranging from 850° to about 1200° F., preferably at a temperature ranging from about 950° F. to about 1100° F. and at a pressure ranging from about 0 to about 150 psig, preferably under 45 psig in a once-through manner, that is, without recycle of the heavy hydrocarbonaceous oil from the coking zone effluent. The oil feed upon contact with the hot fluidized solids in the coking zone undergoes pyrolysis evolving lower boiling hydrocarbon products including normally liquid hydrocarbons of reduced content of metal contaminants and depositing coke on the solids. The coke produced in the fluid coking zone comprises from about 90 to about 98 weight percent of the metal contaminants of the oil feed to the fluid coking zone.

A stream of coke-covered solids is removed from the coking zone via line 18 and sent to a heating zone (not shown). Heated solids are subsequently recirculated to the coking zone in a conventional manner.

The vaporous coking zone products are passed via line 20 to a conventional separation zone wherein the products are separated into gases, removed by line 22, at least one normally liquid light hydrocarbon fraction recovered by line 24 and a heavier hydrocarbonaceous fraction including, unconverted heavy hydrocarbon, which is passed via line 26 to a delayed coking zone. The heavy oil which is separated from the vaporous fluid coking zone effluent has a decreased amount of metal contaminants relative to the oil feed to the fluid coking zone. The heavy oil removed by line 26 may have a metals content 3 to 9 times less than the metals content of the oil feed to the fluid coking zone. The initial boiling point of the heavy oil removed by line 26 may range from about 650° to about 975° F., at atmospheric pressure. Preferably the heavy oil will have an atmospheric pressure boiling point above about 975° F. Coking the heavy oil feed in a once-through fluid coking stage will yield a higher amount of 975° F. boiling constituents in the 650° F.+ fraction than would be obtainable in a delayed coking stage. This is due to the fact that the steam used to fluidize the bed aids in lifting the heavier hydrocarbons out of the bed and that higher reactor temperatures are normally employed in a fluid coking reactor. If the initial feed to the fluid coking zone comprises ash, the heavy oil recovered by line 26 will also have a lower ash content than the initial oil feed to the fluid coker since the coke produced in the fluid coking zone will comprise some of the ash as well as some of the metallic contaminants that are present in the initial oil feed. The low metals heavy oil fraction passed by line 26 to delayed coking zone 3 is coked therein at a temperature not greater than 950° F., that is, a temperature ranging from about 775° F. to about 950° F. and at a pressure ranging from about 10 to about 200 psig, preferably from about 10 to about 100 psig.

Reaction in the delayed coking zone produces a vapor phase effluent, including normally liquid hydrocarbons, which is removed via line 28 and a coke product having a low metal content. The vanadium content of the coke produced in the delayed coking zone may range from less than 600 wppm, based on the coke, preferably less than 300 wppm, based on the coke of the delayed coker. The coke of the delayed coking zone may be recovered from the drum in a conventional way, such as by spalling with water jets or by known mechanical means. The recovered coke is schematically indicated as being recovered via line 30 in the drawing.

What is claimed is:

1. A process for producing a low metal-containing coke, which comprises the steps of:

(a) contacting a heavy hydrocarbonaceous oil feed containing metal contaminants and having a Conradson carbon content of at least 5 weight percent with hot coke particles in a fluidized bed coking zone maintained at a temperature ranging from about 850 to about 1200° F. to produce coke having a high metals content and a vapor phase effluent, including a heavy hydrocarbonaceous oil having a reduced metals content relative to said oil feed;

(b) treating at least a portion of said heavy hydrocarbon oil having the reduced metals content in a delayed coking zone maintained at a temperature below about 950° F. to produce coke having a low content of metal; and (c) recovering said low metals content coke.

2. The process of claim 1 wherein said heavy oil having said reduced metals content of step (b) has an initial atmospheric pressure boiling point ranging from about 650° F. to about 975° F.

3. The process of claim 1 wherein said heavy oil having said reduced metals content of step (b) has an atmospheric pressure boiling point above about 975° F.

4. The process of claim 1 wherein said heavy oil of reduced metals content of step (b) has a metal content ranging from about 3 to 9 times less than the metals content of said heavy oil feed of the fluid coking zone.

5. The process of claim 1 wherein said recovered low metals content coke has a vanadium content below about 600 wppm, based on the coke.

6. The process of claim 1 wherein said heavy oil feed to the fluid coking zone also comprises ash and wherein the heavy oil separated from said vapor phase effluent has a lower ash content than the heavy oil feed and wherein said recovered low metals content coke also has a low ash content.

7. The process of claim 1 wherein said fluid coking zone is maintained at a temperature ranging from about 950° to about 1100° F. and wherein said delayed coking zone is maintained at a temperature ranging from about 775° to less than 950° F.

8. The process of claim 1 wherein said fluid coking is conducted without recycle of heavy hydrocarbonaceous oil to said fluid coking zone.

* * * * *